US008081766B2

(12) United States Patent
Gunness

(10) Patent No.: US 8,081,766 B2
(45) Date of Patent: Dec. 20, 2011

(54) CREATING DIGITAL SIGNAL PROCESSING (DSP) FILTERS TO IMPROVE LOUDSPEAKER TRANSIENT RESPONSE

(75) Inventor: David W. Gunness, Sutton, MA (US)

(73) Assignee: LOUD Technologies Inc., Woodinville, WA (US)

( * ) Notice: Subject to any disclaimer, the term of this patent is extended or adjusted under 35 U.S.C. 154(b) by 1171 days.

(21) Appl. No.: 11/368,554

(22) Filed: Mar. 6, 2006

(65) Prior Publication Data

US 2007/0223713 A1 Sep. 27, 2007

(51) Int. Cl.
*H04R 29/00* (2006.01)

(52) U.S. Cl. ..... 381/59; 381/96

(58) Field of Classification Search ..... 381/96, 381/58, 59, 97, 150, 337, 339, 340, 343, 381/98, 99; 181/144, 199, 198
See application file for complete search history.

(56) References Cited

U.S. PATENT DOCUMENTS

| | | | | |
|---|---|---|---|---|
| 5,027,410 | A | 6/1991 | Williamson et al. | |
| 5,091,952 | A | 2/1992 | Williamson et al. | |
| 5,307,417 | A | 4/1994 | Takamura et al. | |
| 5,386,475 | A | 1/1995 | Birck et al. | |
| 5,511,129 | A | 4/1996 | Craven et al. | |
| 5,559,893 | A | 9/1996 | Krokstad et al. | |
| 5,600,718 | A | 2/1997 | Dent et al. | |
| 5,627,899 | A * | 5/1997 | Craven et al. | 381/98 |
| 5,636,272 | A | 6/1997 | Rasmusson | |
| 5,657,384 | A | 8/1997 | Staudacher et al. | |
| 5,680,450 | A | 10/1997 | Dent et al. | |
| 5,715,319 | A | 2/1998 | Chu | |
| 5,790,671 | A | 8/1998 | Cooper | |
| 5,815,580 | A | 9/1998 | Craven et al. | |
| 5,953,432 | A | 9/1999 | Yanagawa et al. | |
| 5,987,145 | A | 11/1999 | Lawton | |
| 6,094,495 | A * | 7/2000 | Rocha | 381/340 |
| 6,097,943 | A | 8/2000 | Nordwall | |
| 6,101,474 | A | 8/2000 | Fujibayashi | |
| 6,118,883 | A | 9/2000 | Rocha | |
| 6,473,625 | B1 | 10/2002 | Williams et al. | |
| 6,584,204 | B1 * | 6/2003 | Al-Ali et al. | 381/96 |
| 6,614,911 | B1 | 9/2003 | Watson et al. | |
| 6,621,909 | B1 * | 9/2003 | Webb et al. | 381/342 |
| 6,731,760 | B2 | 5/2004 | Pedersen | |
| 6,738,486 | B2 | 5/2004 | Kaulberg | |
| 6,744,887 | B1 | 6/2004 | Berstein et al. | |
| 6,760,451 | B1 * | 7/2004 | Craven et al. | 381/98 |
| 6,795,557 | B1 | 9/2004 | Makirvirta et al. | |
| 6,898,293 | B2 | 5/2005 | Kaulberg | |
| 2003/0169892 | A1 | 9/2003 | Ura | |
| 2003/0194096 | A1 | 10/2003 | Kennedy et al. | |
| 2004/0028239 | A1 | 2/2004 | Watson et al. | |
| 2004/0064197 | A1 | 4/2004 | Nakaishi | |
| 2004/0170293 | A1 | 9/2004 | Watson et al. | |

* cited by examiner

*Primary Examiner* — Xu Mei
*Assistant Examiner* — Lun-See Lao
(74) *Attorney, Agent, or Firm* — Christensen O'Connor Johnson Kindness PLLC

(57) ABSTRACT

A method is provided for creating a series of digital signal processing (DSP) filters to improve the transient response of a loudspeaker, wherein the loudspeaker is formed of multiple components. The method includes generally six steps. The first step involves identifying a substantially linear, time-invariant, and spatially-consistent loudspeaker mechanism causing transient response distortion. The second step involves characterizing the identified mechanism. The third step involves determining the characterized mechanism's two-port response. The fourth step involves establishing a target response for the characterized mechanism. The fifth step involves calculating an ideal filter to achieve the target response. The sixth step involves designing a cost-reduced filter based on the ideal filter.

18 Claims, 5 Drawing Sheets

CREATING DIGITAL SIGNAL PROCESSING (DSP) FILTERS TO IMPROVE LOUDSPEAKER TRANSIENT RESPONSE

FIELD OF THE INVENTION

The present invention relates generally to loudspeaker systems and, more particularly, to loudspeaker systems including digital signal processing (DSP) filters that are created to improve the loudspeaker's transient response.

BACKGROUND OF THE INVENTION

A loudspeaker is a device which converts an electrical signal into an acoustical signal (i.e., sound) and directs the acoustical signal to one or more listeners. In general, a loudspeaker includes an electromagnetic transducer which receives and transforms the electrical signal into a mechanical vibration. The mechanical vibrations produce localized variations in pressure about the ambient atmospheric pressure; the pressure variations propagate within the atmospheric medium to form the acoustical signal. A horn-type loudspeaker typically includes a transducer assembly, an acoustical transformer, and an acoustical waveguide or horn.

FIG. 1A is a sectional view of a transducer assembly 10, an acoustical transformer (alternately known as a phase plug) 11, and a horn 12, as disclosed in U.S. Pat. No. 6,094,495, which is incorporated by reference herein. The transducer assembly 10, shown in more detail in the sectional view of FIG. 1B, includes a cone-type driver including a voice coil 13, an annular cone having an outer portion 14 and an inner portion 16, and a dust cap 17 attached to and covering the voice coil 13. The sectional view of FIG. 1B shows one half of the transducer assembly 10 sectioned at the central axis CA, which is preferably the axis of propagation of the acoustic energy generated by the loudspeaker system. Both the outer portion 14 and the inner portion 16 of the cone are in the form of a cone truncated at both ends. The periphery of the smaller end of the outer portion 14 and the periphery of the larger end of the inner portion 16 coincide at a junction 18, and the cone is fixedly attached to the voice coil 13 at the junction 18. The dust cap 17 is fixedly attached to the inner portion 16 of the cone, and intersects the central axis CA at the dust cap peak 19.

The distance from the junction 18 to the dust cap peak 19 along the inner portion 16 of the cone and the dust cap 17 is designated as D1. The distance from the junction 18 to an outer periphery 15 along the outer portion 14 of the cone is designated as D2. Preferably, the distance D1 is substantially equal to the distance D2. Mechanical vibrations travel through the outer portion 14 and the inner portion 16 along equidistant paths D2 and D1, respectively, and thus the dust cap peak 19 and the outer periphery 15 of the outer portion 14 of the cone produce acoustical signals which have a substantially equal time relationship.

Still referring to FIG. 1B, the acoustical transformer 11 (i.e., the phase plug) is typically disposed adjacent to the transducer assembly 10 so as to reduce the volume of an air chamber 2 driven by the transducer assembly 10. This in turn reduces the mechanical reactance that only permits mechanical vibrations at lower frequencies, to thereby allow mechanical vibrations at higher frequencies also. As illustrated, the rear face of the phase plug 11 facing the transducer assembly 10 includes a first conical section 3 which faces the outer portion 14 of the cone, and a second conical section 4 which faces the inner portion 16 of the cone and the dust cap 17. The first and second conical sections 3 and 4 meet at a peak 5.

FIG. 1C shows the rear face of the phase plug 11 facing the transducer assembly 10. A solid line, labeled 5, is used to indicate the location of the peak 5. The central axis CA is shown as a point at the center of the phase plug 11. As shown, the phase plug 11 includes a plurality of elongated radial slots 6, with six being shown as 6*a* through 6*f*, extending radially from an inner radial location "R" out to the edge 7. Each of the elongated slots 6*a*-6*f* forms with the phase plug 11 an internal acoustical waveguide which extends in the direction of the central axis CA. These various waveguide paths through the slotted phase plug 11 preferably provide the same effective length through which acoustical signals from the diaphragm (the cone in this case) travel so that the signals produced from the front face of the slotted phase plug 11 have a substantially equal time relationship.

The acoustical waveguide or a horn 12 receives the acoustical signal radiated by the transducer assembly 10 and the phase plug 17 and directs the signal in a particular direction.

In the loudspeaker as described above in reference to FIGS. 1A-1C, the slots 6*a*-6*f* serve to reduce the amount of path length variation to thereby achieve substantially coherent acoustical signal transmission and production. There remains, however, a range of transient variations among various signal paths through the slotted phase plug 11 (e.g., some signals from the diaphragm not entering the nearest slot, re-entering multiple slots, etc.). In fact, any type of phase plug, due to its particular configuration, inherently suffers from a certain degree of transient variations among various signal paths through the phase plug. Although the time difference may be only a fraction of a millisecond, it is enough to color the resulting acoustical signal radiated from the transducer assembly 10 such that the acoustical signal is not a true representation of the original acoustical source.

The present invention is directed to creating a series of digital signal processing (DSP) correction/preconditioning filters to be incorporated into a loudspeaker system, to correct sound inaccuracies caused by various physical behaviors of loudspeaker components, such as transient smear caused by the multiple paths through a compression driver phase plug as described above.

SUMMARY OF THE INVENTION

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present invention, a method is provided for creating a series of digital signal processing (DSP) filters to improve the transient response of a loudspeaker, wherein the loudspeaker is formed by multiple components. The method includes generally six steps. The first step involves identifying a substantially linear, time-invariant, and spatially-consistent loudspeaker mechanism causing transient response distortion. The second step involves characterizing the identified mechanism, for example, based on computer modeling or mechanical or acoustical measurements. The third step involves determining the characterized mechanism's two-port response, such as its frequency response or impulse response. The fourth step involves establishing a target response for the characterized mechanism. The fifth step involves calculating an ideal filter to achieve the target response. Finally, the sixth step involves designing a cost-reduced filter based on the ideal filter to form a loudspeaker mechanism algorithm (LMA) filter.

In accordance with one aspect of the present invention, the loudspeaker mechanism to be digitally corrected may be any one of: transient smear due to a compression driver phase plug configuration, acoustical horn resonances, and mechanical radial resonances in loudspeaker cones.

In accordance with another aspect of the present invention, LMA filters may be constructed based on one or more of a Finite Impulse Response (FIR) filter, Infinite Impulse Response (IIR) filter, and biquadratic (biquad) filter.

In accordance with another embodiment of the present invention, a method is provided for creating a series of digital signal processing (DSP) filters to improve the transient response of a loudspeaker, wherein the loudspeaker is formed of multiple components. The method includes generally nine steps. The first six steps are applied with respect to each component, and include: (1) identifying a substantially linear, time-invariant and spatially-consistent loudspeaker mechanism; (2) characterizing the identified mechanism; (3) determining the characterized mechanism's two-port response; (4) establishing a target response for the characterized mechanism; (5) calculating an ideal filter to achieve the target response; and (6) designing a cost-reduced filter based on the ideal filter to thereby form a loudspeaker mechanism algorithm (LMA) filter. The steps (1)-(6) may be performed repeatedly with respect to the same component to thereby form multiple LMA filters, each addressing one of multiple mechanisms of the component that may be causing transient response distortion. Then, for all components, the method involves the steps of: (7) applying minimum phase filters to equalize multiple frequency ranges; (8) applying linear phase crossover filters; and (9) repeating any of the steps (1)-(8) above to achieve a combined loudspeaker response that exhibits reproduction accuracy.

In accordance with a further embodiment of the present invention, a loudspeaker system is provided, which includes multiple components and a series of digital signal processing (DSP) filters that are created to improve the loudspeaker's transient response. The DSP filters consist of loudspeaker mechanism algorithm (LMA) filters that are each configured to correct a substantially linear, time-invariant, and spatially-consistent loudspeaker mechanism causing transient response distortion.

In accordance with one aspect of the present invention, at least one of the LMA filters is configured to correct any one or more of: transient smear due to a compression driver phase plug configuration, acoustical horn resonances, and mechanical radial resonances in loudspeaker cones.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PRESENT INVENTION

As used herein, a loudspeaker system (or loudspeaker in short) means a complete loudspeaker including multiple components, such as one or more transducers (e.g., a compression driver, woofer, dome tweeter, etc.), one or more phase plugs, one or more horns, and a series of DSP correction filters created in accordance with the present invention. A loudspeaker component (or component in short) means a component that, together with other components, constitutes a loudspeaker system.

In various exemplary embodiments of the present invention, the creation of DSP filters consists of generally two parts. First, a plurality of loudspeaker mechanism algorithm (LMA) filters are created to each correct a particular loudspeaker mechanism that is causing transient response distortion. Second, the LMA filters are further processed and combined to form loudspeaker system algorithm (LSA) filters, which correct and improve the transient response of a loudspeaker system as a whole. The LMA and LSA will be described in detail later.

Figure 2:
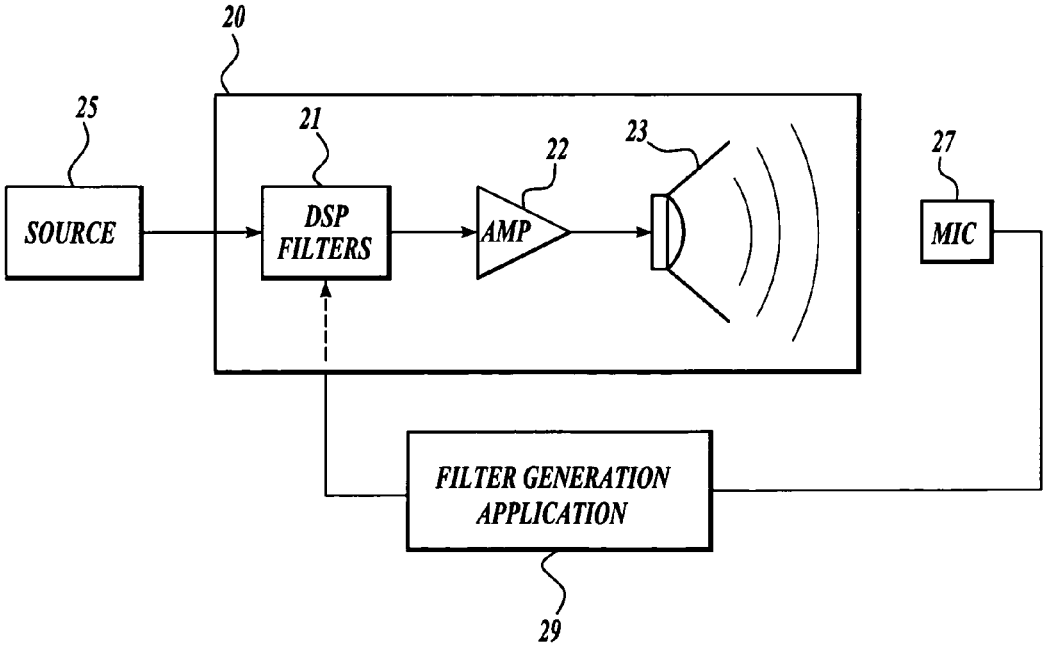
FIG. 2 shows a schematic of how a series of DSP correction filters are created and incorporated in a loudspeaker system in accordance with one embodiment of the present invention.

FIG. 2 illustrates how DSP correction filters are created and incorporated in a loudspeaker system in accordance with one embodiment of the present invention. A loudspeaker system 20 includes DSP correction/preconditioning filters 21, an amplifier 22, and a combination 23 of a transducer assembly, a phase plug, and a horn. Once the DSP filters 21 are created and incorporated into the loudspeaker system 20, an electrical signal from a source 25 enters the loudspeaker 20 via the DSP filters 21, which then correct various sound inaccuracies inherent in the loudspeaker system 20 so that an acoustical signal output from the combination 23 exhibits improved transient response.

To create the DSP filters 21, a microphone 27 may be placed within the range of the loudspeaker 20, which receives and sends the acoustical signal output from the loudspeaker 20 to a filter generation application 29. The filter generation application 29 then automatically and/or semi-automatically processes the received acoustical signal to generate the DSP filters 21 according to various exemplary embodiments of the present invention. For example, at least some of various steps of LMA and LSA, described in detail below, may be performed automatically and/or semi-automatically in connection with the filter generation application 29.

Loudspeaker Mechanism Algorithm (LMA)

Figure 3:
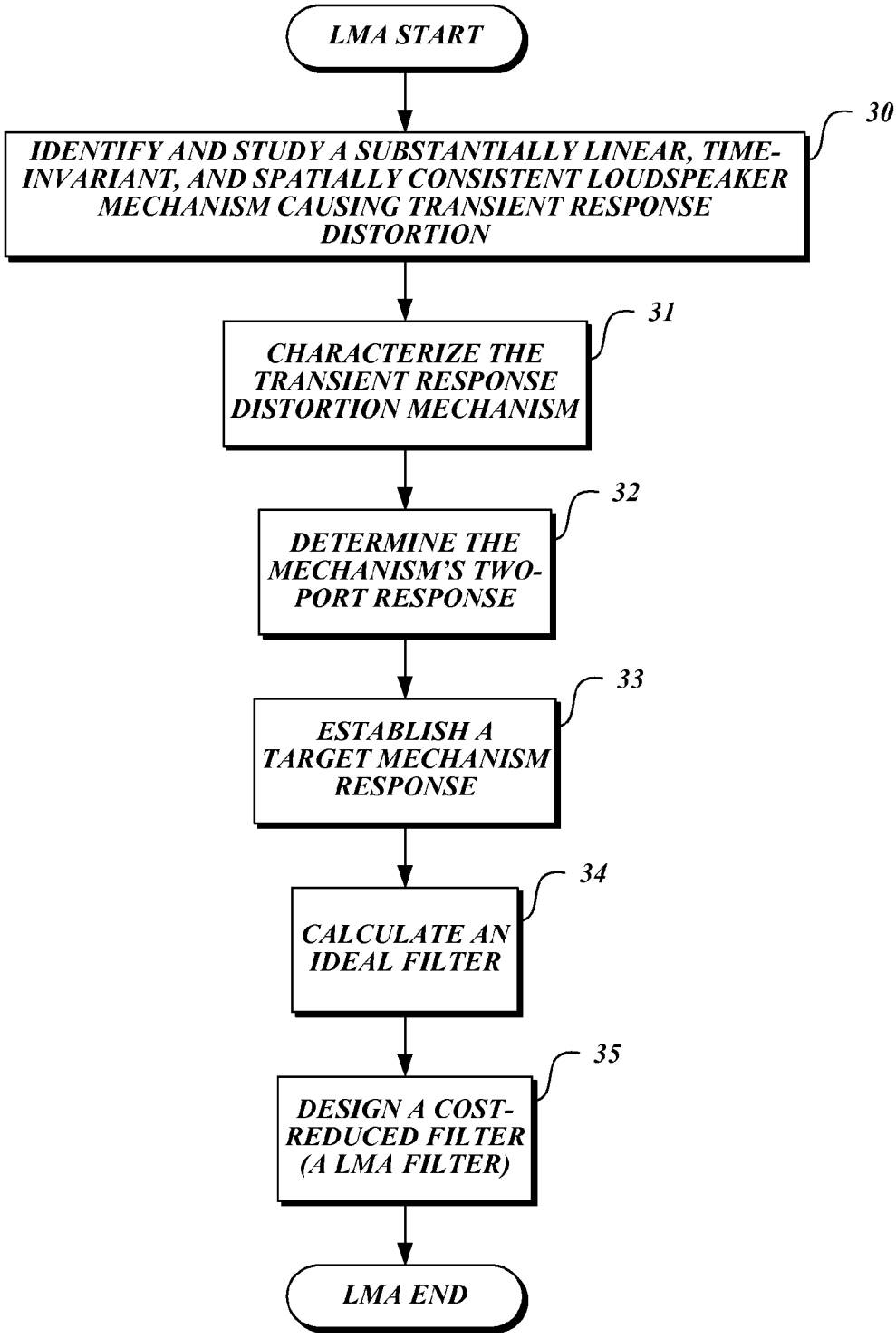
FIG. 3 is a flowchart illustrating a process of the Loudspeaker Mechanism Algorithm (LMA) in accordance with one embodiment of the present invention.

In accordance with various exemplary embodiments of the present invention, a series of filters (LMA filters) are created to each address and correct for a particular physical mechanism within a loudspeaker that is causing transient response distortion. In one embodiment of the present invention, LMA (for creating an LMA filter) consists of generally six steps, as shown in the flowchart of FIG. 3 and described below.

First, in step 30, a loudspeaker mechanism that is a potential source of transient response distortion is identified and studied. As used herein, "loudspeaker mechanism" (or mechanism in short) refers to an identifiable physical behavior of a loudspeaker component, which may be causing a performance flaw. Also as used herein, "transient response" means the ability of a loudspeaker to quickly and accurately reproduce a short-lived aspect of a sound signal such as the attack and decay of musical tones. Further as used herein, "transient response distortion" means any change or variation in the transient response of a loudspeaker, which may be evidenced by rapid variations of phase with frequency. Such loudspeaker mechanisms, which may be causing transient response distortion and are to be corrected by DSP filters in accordance with the present invention, may include, for example, transient smear due to the multiple paths through a compression driver phase plug, acoustical horn resonances, and mechanical radial resonances in loudspeaker cones.

It should be understood that a loudspeaker mechanism to be identified for digital correction needs to be a mechanism resulting from stable, correctable behaviors. Specifically, the transient response of a loudspeaker typically represents the combined effect of a multitude of physical behaviors of components forming the loudspeaker. Some of these behaviors are nonlinear, time-variant, or spatially variable and therefore are not good candidates for digital correction. Other behaviors are sufficiently linear and time-invariant (LTI) and further sufficiently consistent spatially (or directionally) to be largely correctable with specialized digital filters. The present invention is directed to creating DSP filters to correct only those sufficiently LTI and spatially consistent behaviors, to thereby improve the transient response of a loudspeaker.

It is a relatively simple matter to measure the frequency response of a loudspeaker at a particular point in space, and then invert the measured response to generate a complementary digital filter. However, in many cases, the results obtained from such complementary filters are less than satisfactory. This is because the process of simply inverting the measured response allows not only LTI and spatially consistent behaviors but also nonlinear, time-variant, and spatially variant behaviors to be incorporated into a complementary filter. Consequently, the resulting filter can actually make the response worse at output levels different from the original measurement level or in some directions different from the original measurement direction. The filter can also cease to be useful at some point as certain characteristics of the loudspeaker may vary over time.

Based on the above considerations, the present invention proposes a more sound approach to target specific, physical behaviors (or mechanisms) of a loudspeaker component which are sufficiently LTI and spatially consistent. In accordance with one embodiment of the present invention, there are generally five criteria to use in targeting a specific loudspeaker mechanism: (1) a two-port system, (2) linearity, (3) time invariance, (4) unit-to-unit invariability, and (5) minimum phase and non-minimum phase systems. These criteria will be described in detail below.

A. Two-Port Systems

In general, for the transient response of a loudspeaker system to be reliably improved by a signal preconditioning filter, the individual components to be corrected should each be two-port systems. A two-port system may be defined as a system with one input and one output. Two port systems can be characterized by a single transfer function, which describes the output of the system as a function of its input. If a transfer function has undesirable characteristics, they can be eliminated by introducing a signal preconditioning filter before the input to the system, or after the system's output.

Loudspeakers, in general, are not two-port systems, because their transfer functions vary with both direction and distance. A preconditioning filter may improve the response in one direction, while making it worse in another. However, many of the components (or mechanisms) that are used to construct a loudspeaker are two-port in nature. As a result, a preconditioning filter designed to address a specific component may improve the performance of the loudspeaker in all directions, or at least over the loudspeaker's intended coverage pattern.

B. Linearity

All loudspeakers produce audible, level-dependent artifacts. Those artifacts that have a sudden onset, such as voice coil bottoming and cone collapse, can only be avoided by some form of limiting. Those artifacts that change gradually (but non-linearly) can affect the response in a way that changes over the usable range of a loudspeaker.

For example, the non-linearity of compliant elements may result in a system which grows effectively stiffer as the excursion increases. The modal behavior or "break-up" of compression driver surrounds and diaphragms may change as the stresses in the structure change, which can cause response peaks and notches to shift in frequency. Voice coils become hot, which results in reduced transduction efficiency and decreased electrical damping.

The significance of these and other level-dependent behaviors is that a preconditioning filter affected by one or more of these behaviors may only be effective over a narrow range of drive levels. At other levels, the filter may well make the response worse.

Therefore, when developing preconditioning filters, it is important to identify and isolate any level-dependent behaviors. Their effects must either be excluded from the filters, or implemented in a level-dependent manner. In other words, the mechanism to be corrected by a DSP filter in accordance with the present invention should be linear and largely level-independent.

C. Time Invariance

The characteristics of a loudspeaker can vary over time due to changes in the environment. For instance, a paper cone might increase in mass as it takes on moisture when the humidity is high. Unusually high or low temperatures can affect both the compliance and damping of suspensions, the voice coil resistance, and the strength of permanent magnets.

Characteristics can also vary over time when a loudspeaker is exposed to damaging signals. The stiffness of compliant elements may change due to incidents of high excursion. Cones and diaphragms can become weakened from repeated exposure to high mechanical force or air pressure.

To the extent that such variations are predictable, filters may be optimized for the middle of the range of variation, or for the condition that is expected to be encountered in normal use. However, if a particular mechanism cannot be corrected over a usefully broad range, care must be taken to eliminate the mechanism's effects from the preconditioning filters.

D. Unit-to-Unit Invariability

Some characteristics of loudspeakers can be produced consistently across multiple units built to a given specification. Physical dimensions in particular, such as phase plug slot spacing, can be produced very consistently. Parameters that depend on less easily controlled factors may be much more variable. Magnetic material properties, the stiffness and internal damping of metal foils, and paper cone formulation are just a few examples of sources of potential manufacturing variability.

When developing preconditioning filters for production loudspeakers, mechanisms to be identified for digital correction should not be subject to excessive unit-to-unit variability.

E. Minimum Phase and Non-Minimum Phase Systems

A system is defined as being minimum-phase if both the system transfer function and its inverse are causal and stable. Thus, if a correction or preconditioning filter can be created that corrects the magnitude response of a minimum phase system (so that the system's response does not go to zero at any frequency), it can also correct the phase response, yielding a perfect impulse response with no latency.

Because of this property of minimum phase systems, it has often been stated that non-minimum phase effects cannot be corrected by preconditioning filters. In fact, it is only true that a non-minimum phase system cannot be corrected perfectly. However, the imperfection may simply be latency, which in audio, is an exceptionally benign imperfection.

All loudspeaker systems are subject to significant latency, because of the relatively slow propagation speed of sound in air. Therefore, a small amount of added latency is usually inconsequential. In some cases, a filter can be defined which corrects a non-minimum phase system's magnitude response, and which linearizes the system's phase response. The net result is a system which is perfect in the sense that its impulse response is a delta function, but in which the impulse is not located at t=0. In other cases, a filter can be defined which approximately corrects a system's magnitude response and approximately linearizes the system's phase response, while introducing minimum latency. In short, many non-minimum-phase behaviors are practically correctable in the context of audio applications.

In summary, a loudspeaker mechanism to be digitally corrected in accordance with one embodiment of the present invention may be selected based on the above-described criteria, i.e., a loudspeaker mechanism that is a two port system, sufficiently linear and time-invariant (LTI), with a limited amount of unit-to-unit variability, and may be a minimum-phase or non-minimum phase system. The three examples of loudspeaker mechanisms that can be digitally corrected in accordance with the present invention, i.e., transient smear due to the multiple paths through a compression driver phase plug, acoustical horn resonances, and mechanical radial resonances in loudspeaker cones, all satisfy these criteria.

The identified transient response distortion mechanism is studied in detail. A thorough understanding of the nature of the mechanism will be helpful in determining the best approach for characterizing its effect, assessing the variability of its effect, and assessing the efficacy of open-loop DSP-based correction in accordance with the present invention. The nature of the mechanism will also dictate what type or combination of filter(s) will be most effective in correcting for the effect of the mechanism.

Second, in step 31, the transient response distortion mechanism identified and studied above is characterized. Depending on the particular mechanism, characterization may be accomplished by mathematical modeling, mechanical or acoustical transfer function measurements, electrical impedance measurements, or any combination of these and other characterization tools which will be apparent to one skilled in the art. For example, electrical impedance measurements may be used to verify and refine a mathematical model.

Acoustical measurements represent the net result of numerous mechanisms, some of which are correctable, and some of which are not correctable. The existence of the uncorrectable mechanisms makes it difficult to isolate the correctable mechanisms. Consequently, there is a very limited set of cases in which an effective characterization can be accomplished with acoustical measurements alone.

Third, in step 32, the mechanism's "two-port" response is determined (i.e., it is determined how the mechanism serves as a transfer function to produce one output based on one input). Specifically, regardless of what method is used to characterize the transient response distortion mechanism in step 31, an impulse or complex frequency response is obtained for the characterized mechanism, which represents the way that the response of the loudspeaker is modified by the characterized mechanism. As used herein, an impulse response plots sound pressure versus time measurement to show how a loudspeaker responds to an impulse (i.e., a very short, or "transient" acoustical signal). A complex frequency response plots the range of frequencies a loudspeaker will produce versus their respective amplitude levels.

Fourth, in step 33, a target response is established. The target response is a smooth response curve with the same general shape as the mechanism's two-port response determined in step 32 above, but which lacks the fine details such as response ripple and deviation of phase response from so-called "minimum phase plus latency". This can be done manually, or algorithmically. The algorithmic approach typically includes two steps. First, the magnitude response is smoothed to remove ripples. Second, a Hilbert transform, well known in the art, is used to calculate the minimum phase response for that magnitude response.

Fifth, in step 34, an ideal filter is calculated. Specifically, the mechanism response is deconvolved from the target response. This yields an ideal filter response, which when applied to the corresponding loudspeaker component would substantially negate the effect of the identified mechanism.

There are generally three types of filters that may be selectively employed to create an ideal DSP filter in accordance with various exemplary embodiments of the present invention: Finite Impulse Response (FIR) filter, Infinite Impulse Response (IIR) filter, and biquadratic (biquad) filter.

Briefly, an FIR filter is also called a "Moving Average" or "non-regenerative" filter. Each output value from an FIR filter is a weighted average of the most recent input value and N previous input values. The weightings for each of the (1+N) input values are informally called taps, and are often referenced in technical literature as the "b" coefficients, $b_n$, where n varies from 0 to N.

An IIR filter is also called an "Auto Regressive" or "regenerative" filter. Each output value from an IIR filter is a weighted average of the most recent input value and M previous output values. The weightings for each of the M previous output values are often referenced in technical literature as the "a" coefficients, an, where n varies from 1 to M. IIR filters are nearly always implemented in combination with some number of FIR taps. The combination is still an IIR filter, because the regenerative "a" coefficients result in an infinite impulse response, with or without the non-regenerative FIR part.

A biquad filter is a digital filter with N=2 (the number of previous input values that are weight-averaged), and M=2 (the number of previous output values that are weight-averaged). Most commercial realizations of IIR filters are implemented with multiple biquad filters.

An ideal filter for correcting a particular loudspeaker mechanism may be constructed by selectively employing one or more of these conventional filters, as the unique characteristics and applications of each of these filters are well known to one skilled in the art.

The ideal filter, however, may have a non-causal component, and it may be too complex for the available digital signal processing (DSP) power. It may also have too much latency for the particular application. Consequently, the ideal filter may not be directly useable, but can be used only as a starting point (or a target) for designing a "cost-reduced" filter to be described below.

Sixth, in step 35, a cost-reduced filter is designed based on the ideal filter derived above. The "cost" of a filter generally refers to the amount of digital signal processing (DSP) power it requires, which in turn is governed by the total number of taps. The objective of the cost-reduced filter is to match its response to the response of the ideal filter as closely as possible, using only the number of taps allotted to the mechanism. As with an ideal filter, a cost-reduced filter may be designed by selectively employing one or more types of conventional filters, such as FIR, IIR, and biquad filters.

Cost-reduced filters for correcting some mechanisms can be constructed based on conventional FIR filters. To design such a filter, the ideal filter impulse response is windowed. The length and shape of the window used can be adjusted to achieve an optimum balance between temporal correction, magnitude response deviation, transient artifacts, latency, and filter length.

Correction of other mechanisms may require a combination of FIR/IIR techniques (sometimes called AutoRegressive-Moving-Average, or ARMA). A number of techniques for determining optimum filter coefficients for ARMA are well known in the art, such as Prony's method and the Pade method.

In various exemplary embodiments of the present invention, a cost-reduced filter is the final product of the LMA process, and therefore is alternatively referred to herein as an LMA filter.

As described above, the loudspeaker mechanisms that are digitally correctable and for which LMA filters can be designed in accordance with the present invention include, without limitation, transient smear due to the multiple paths through a compression driver phase plug, acoustical horn resonances, and mechanical radial resonances in loudspeaker cones. The development of an LMA filter in the context of these three examples is described in detail below. Note that these and other mechanisms to be digitally corrected in accordance with the present invention present sonic problems that are inherent in conventional compression drive phase plugs, cones, and horns. Therefore, correction of these mechanisms will improve the sound quality of a loudspeaker in both time-independent and directionally-independent manners.

Example 1

Compression Driver Phase Plugs

A first example mechanism, which is particularly well suited to digital preconditioning in accordance with the present invention, is the time smear produced by compression driver phase plugs.

Typically the openings in a phase plug are arranged in such a way that, from any point on a loudspeaker diaphragm, the path to an opening is relatively short. The designer of a compression driver intends for all of the sound power produced within the driver to leave via the "nearest exit". However, a significant fraction of the sound energy arriving at a phase plug opening will either continue past it or reflect back from it; in either case arriving later at other phase plug openings (or slots) where the sound is divided again, ad infinitum. Rather than a single acoustical impulse, the response exhibits a decaying sequence of impulses.

Figure 1A:
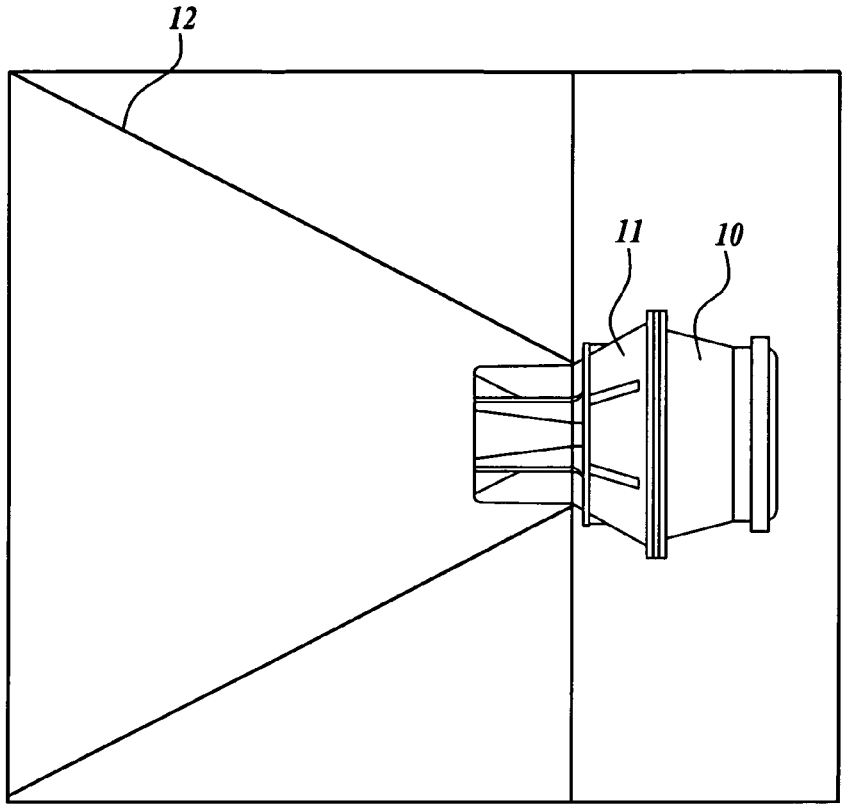
FIG. 1A shows a sectional view of a prior art loudspeaker, including a transducer assembly (e.g., a cone-type driver), a slotted phase plug, and a horn.
Figure 1B:
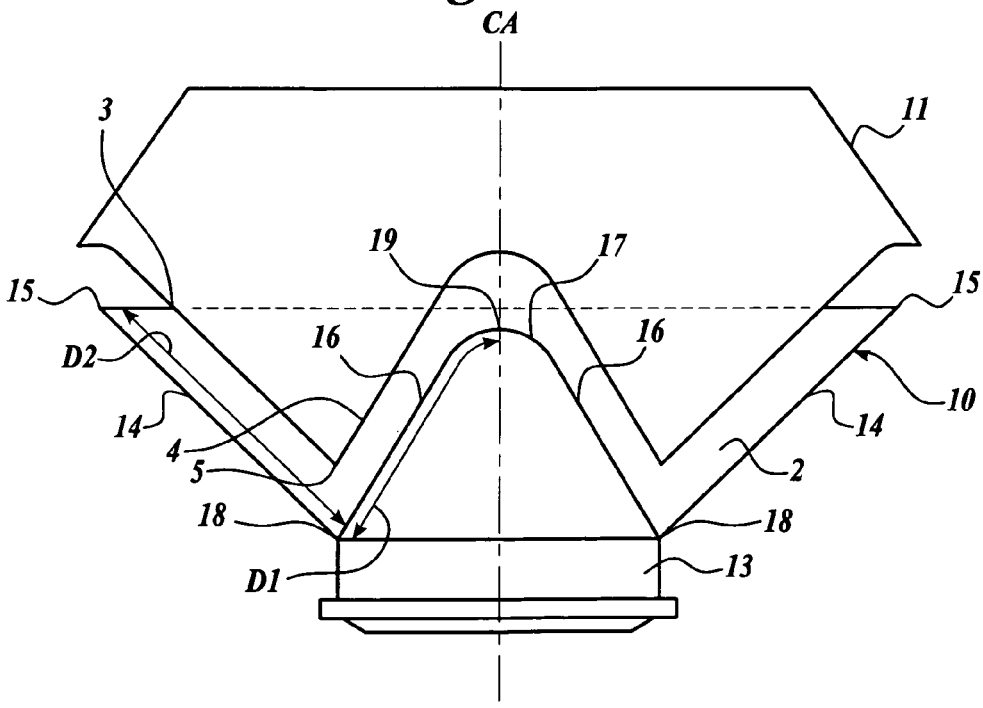
FIG. 1B shows a sectional view of the transducer assembly and the slotted phase plug of FIG. 1A.
Figure 1C:
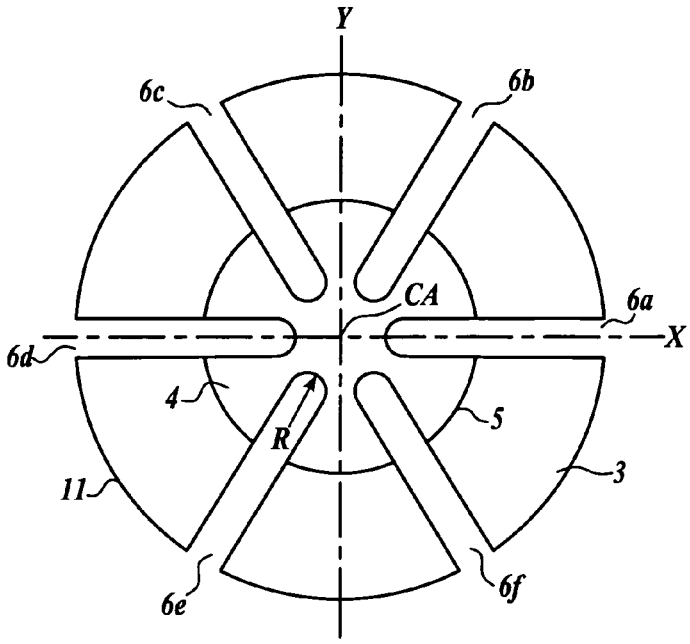
FIG. 1C shows a rear face view of the phase plug of FIG. 1A.
Figure 4A:
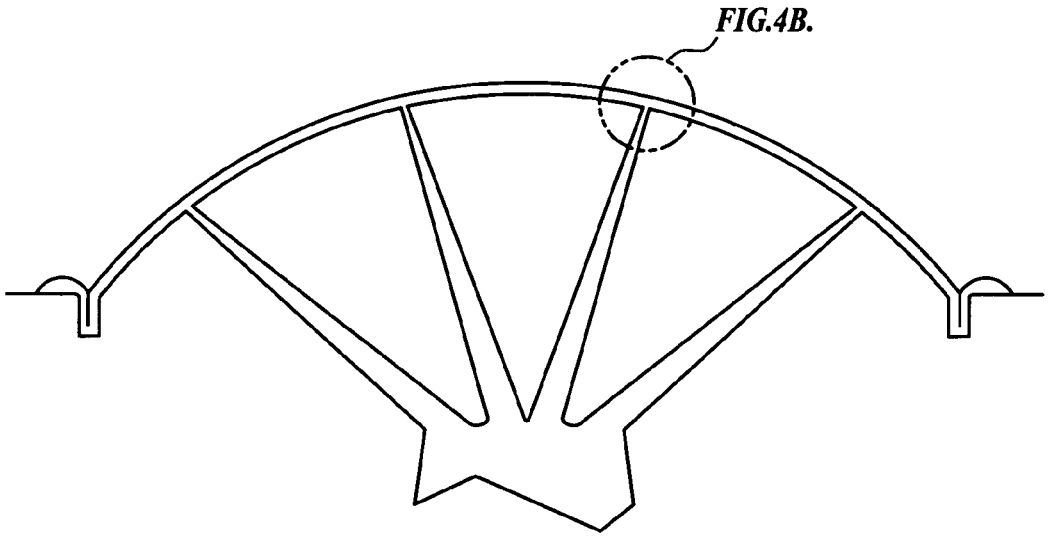
FIGS. 4A and 4B are schematic cross-sectional views of a slotted phase plug of FIG. 1A, showing a "T"-shaped transmission line.
Figure 4B:
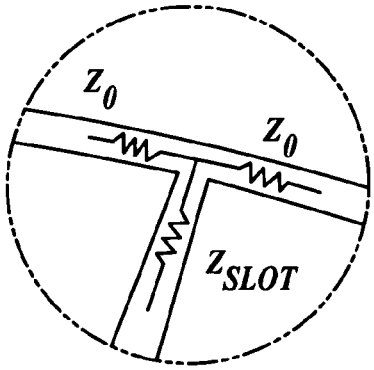

Referring additionally to FIGS. 4A and 4B showing a slotted phase plug as described in reference to FIGS. 1A-1C above, to understand why this occurs, it may be helpful to view the space between the diaphragm and phase plug as a transmission line. At very high frequencies, this is a valid model. Sound propagating through this transmission line will eventually encounter a phase plug slot, which is another transmission line section that can be analyzed as a bulk termination. The characteristic acoustical impedance, $Z_A$, of each of these sections can be calculated as:

$$Z_A = \frac{\rho_O C}{S}, \tag{1}$$

where S is the cross section area of the passage.

At the point that a sound wave traveling across the surface of a phase plug encounters a phase plug slot, the characteristic impedance seen by the advancing sound wave is lower, because the cross sectional area S at that point is the combined area of the phase plug slot and the phase plug-to-diaphragm spacing.

The reflection coefficient of a transmission line termination is:

$$\Gamma = \frac{Z_L - Z_0}{Z_L + Z_0}, \tag{2}$$

and the transmission coefficient is:

$$\tau_0 = \frac{2Z_L}{Z_L + Z_0}, \tag{3}$$

where $Z_L$ is the characteristic impedance of the termination, and $Z_0$ is the characteristic impedance of the transmission line. In the current analysis, the transmission line characterized by $Z_0$ continues beyond the termination, and a "T" branches off from the phase plug slot. Thus, the termination impedance is:

$$Z_L = \frac{Z_0 \cdot Z_{Slot}}{Z_0 + Z_{Slot}}, \tag{4}$$

which is always smaller than $Z_0$. Consequently, no matter what the slot width is, an inverted wave reflects back across the phase plug. Of the power that is not reflected back, a portion enters the phase plug slot and another portion continues across the phase plug in the same direction.

The maximum power transfer into a transmission line branch occurs when $Z_L=Z_0/2$. In a compression driver, this occurs when the slot width is twice the phase plug spacing. One fourth of the power continues, and one fourth of the power reflects back with inverted polarity. If the slot is narrower than twice the phase plug spacing, then more of the sound power continues past the slot. If the slot is wider than twice the phase plug spacing, then more of the power is reflected back. The sound power delivered into the slot never exceeds half the power of the wave arriving at the "T".

This analysis demonstrates why all phase plug designs produce significant smearing of the transient response. This example further serves to illustrate that a carefully constructed filter can correct sound inaccuracies due to the driver phase plugs.

If the exit of the phase plug where the various paths converge were a single point, then the plug would be a true two-port system. Typically it is not, and there is some directional variability in the high frequency response of most compression drivers. However, phase plug correction filters can be constructed, in accordance with the LMA process described above, to improve the transient response everywhere in the coverage pattern of selected horns, with somewhat more improvement in the center of the pattern. With such a preconditioning filter, these loudspeakers exhibit a greatly improved ability to render high frequency detail, an effect that experienced listeners find easily perceptible.

Example 2

Horn Resonance

A second loudspeaker mechanism, which yields well to digital preconditioning in accordance with the present invention, is horn resonance. A wavefront progressing down any horn will encounter one or more discontinuities in the area expansion. All horns present a discontinuity at their mouths. Constant directivity horns often employ a diffraction slot to achieve a wide coverage pattern at high frequencies. The exit of this slot represents a severe discontinuity.

A discontinuity in a horn's expansion produces a reflection. A fraction of the sound power reverses course and returns to the compression driver where it is partially absorbed and partially re-emitted, often several milliseconds late. This process is regenerative, once again producing a decaying series of arrivals. Low frequencies tend to reflect more strongly than high frequencies, so the reflections are most prevalent in the lowest octaves of the horn's usable range. It is this behavior that produces an audible artifact commonly described as a "honk."

The wavefront does not return to the compression driver in a perfectly coherent fashion, but generally the bulk of the reflected energy does converge back at the driver. To the extent that it does, the mechanism acts as a two-port system, and is correctable using a digital filter constructed in the LMA process described above.

Example 3

Cone Resonance

A third loudspeaker mechanism, which also yields well to digital preconditioning in accordance with the present invention, is cone resonance. A cone loudspeaker is far from being a rigid piston. In fact, the most successful cone formulations transmit mechanical vibrations at a speed not too dissimilar to the speed of sound in air. A mechanical wave travels from the voice coil to the surround, where it is only partially absorbed. A portion of the energy is reflected back down the cone to the voice coil, where it is, once again, partially absorbed and partially re-emitted. Unlike a horn, the reflections tend to be strongest at the upper end of the transducer's frequency range. In many cases, the presence of the mechanical resonance defines the upper frequency limit of usability.

The sound reproduced by the initial mechanical wavefront combines with sound produced by later, re-emitted mechanical wavefronts. Each of these contributions is produced by the same radiating system, with the same directionality, so the effect of the resonating system is the same in every direction. Therefore, the behavior of cone resonance is a two-port system, and is correctable with signal preconditioning in accordance with the LMA process of the present invention.

The directionality of a loudspeaker also affects its transient response, but it is not a two-port characteristic. Hence, it cannot be corrected everywhere. However, the transient response can be modified in a way that produces greater consistency throughout the pattern. By improving the transient response in the "worst" direction, at the expense of the transient response in the "best" direction, the sound quality can be made more consistent over the breadth of the coverage pattern.

Loudspeaker System Algorithm (LSA)

Figure 5:
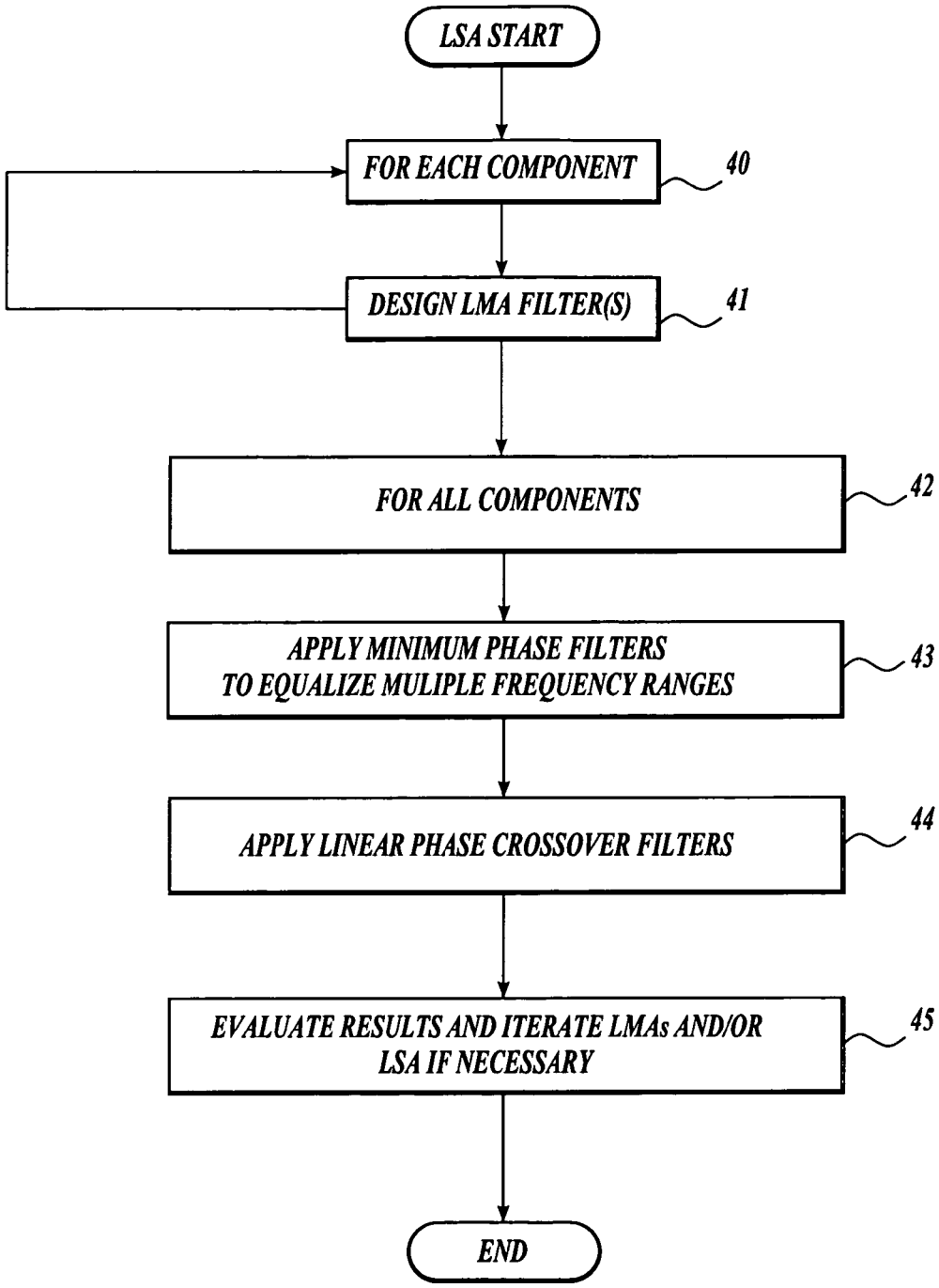
FIG. 5 is a flowchart illustrating a process of the Loudspeaker System Algorithm (LSA) in accordance with one embodiment of the present invention.

Once a number of LMA filters are constructed as described above, to each correct a particular transient response distortion mechanism, then these LMA filters may be further processed and combined to form LSA filters that correct and improve the transient response of a loudspeaker system as a whole. With LSA filters constructed in accordance with the present invention, phase response remains virtually flat, meaning that all frequencies arrive at a listener in the same time relationships as in the original signal. The construction of LSA filters takes generally four steps, as shown in the flowchart of FIG. 5 and described below.

First, for each of the multiple components forming a loudspeaker (see block 40), in step 41, one or more LMA filters are created in accordance with the LMA process described above to each correct a particular distortion mechanism associated with the component. When the LMA filters are applied to the component, the component becomes a nearly minimum phase, ripple-reduced version of itself. Note that step 41 may be repeatedly performed with respect to a single component (e.g., a phase plug) to create multiple LMA filters, each addressing a particular mechanism which is associated with the component and which may be causing transient response distortion. Further, step 41 is performed (one or more times) for each of the multiple components forming a loudspeaker. Thus, step 41 may produce multiple sets of LMAs for multiple components, respectively, wherein each set contains one or more LMAs created for a particular component.

Then, for all of the multiple components forming a loudspeaker system (see block 42), for each of which one or more LMA filters have been created, second, in step 43, conventional, minimum phase filters are applied to equalize multiple frequency ranges to essentially achieve a flat magnitude response and linear phase response. Because the major response deviations of each range are essentially minimum phase in character, minimum phase DSP filters can be used in this step to equalize its response through and somewhat beyond its intended passband. Preferably, conventional biquad-based filters may be used to perform this function.

Third, still for all of the multiple components forming a loudspeaker system, in step 44, linear phase crossover filters are applied, to divide a full-frequency audio signal into two or more signals (high and low, high, mid, and low, etc.). Each signal then feeds a sub-speaker that best reproduces that frequency range. Conventional, biquad-based crossover filters may introduce phase shift, which may undo some of what was accomplished in the LMA filter(s). On the other hand, a crossover filter employing an FIR filter can produce a linear-phase filter. Techniques for designing linear phase crossover filters are well-known in the art.

Fourth, in step 45, the combined loudspeaker response is evaluated based on the analysis of a reproduced acoustic signal that is preconditioned by a series of filters designed and arranged, as described above. If necessary, one or more of the LMA processes performed in step 41 above or any of the steps 43 and 44 within the LSA process may be iterated with some adjustment. In particular, the details of the combined loudspeaker response may suggest revisions to decisions that were made in one or more of the LMA processes. The final product of the LSA process is a series of LSA filters, which correct and improve the transient response of a loudspeaker system as a whole. The LSA filters may then be incorporated into a loudspeaker system (see 21 in FIG. 2) to improve the reproduction accuracy and sound quality of the loudspeaker.

While the preferred embodiments of the invention have been illustrated and described, numerous variations in the illustrated and described arrangements of systems, components, and sequences of operations will be apparent to one skilled in the art based on this disclosure. Various aspects of the invention may be used separately, or in combinations, or in sequences other than those explicitly disclosed. Thus, it will be appreciated that various changes can be made therein without departing from the spirit and scope of the invention.

The embodiments of the invention in which an exclusive property or privilege is claimed are defined as follows:

1. A method of creating a digital signal processing (DSP) filter to improve the transient response of a loudspeaker, wherein the loudspeaker is formed of multiple components, the method comprising:

identifying a loudspeaker mechanism causing transient response distortion, wherein the transient response distortion of the identified loudspeaker mechanism is substantially linear;

wherein the transient response distortion of the identified loudspeaker mechanism does not vary over time;

wherein the transient response distortion of the identified loudspeaker mechanism does not vary with respect to a direction away from the loudspeaker; and wherein the identified loudspeaker mechanism includes a physical behavior of a loudspeaker component;

characterizing the identified mechanism by mathematically modeling the physical behavior of the loudspeaker component and by performing electrical impedance measurements of the loudspeaker component;

determining the characterized mechanism's two-port response;

establishing a target response for the characterized mechanism;

calculating an ideal filter to achieve the target response; and designing a cost-reduced filter based on the ideal filter to thereby form a loudspeaker mechanism algorithm (LMA) filter.

2. The method of claim 1, wherein the identified loudspeaker mechanism further has a limited amount of unit-to-unit variability.

3. The method of claim 1, wherein the identified loudspeaker mechanism is a non-minimum phase system.

4. The method of claim 1, wherein the identified loudspeaker mechanism is selected from a group consisting of: transient smear due to a compression driver phase plug configuration, acoustical horn resonances, and mechanical radial resonances in loudspeaker cones.

5. The method of claim 1, wherein characterizing the identified mechanism includes performing mechanical or acoustical transfer function measurements.

6. The method of claim 1, wherein the step of determining the characterized mechanism's two-port response comprises determining a frequency response of the mechanism.

7. The method of claim 1, wherein the step of determining the characterized mechanism's two-port response comprises determining an impulse response of the mechanism.

8. The method of claim 1, wherein the step of designing a cost-reduced filter to achieve the target response comprises selectively employing one or more of a Finite Impulse Response (FIR) filter, Infinite Impulse Response (IIR) filter, and biquadratic (biquad) filter.

9. A method of creating a series of digital signal processing (DSP) filters to improve the transient response of a loudspeaker, wherein the loudspeaker is formed of multiple components, the method comprising:

(a) for each component:

(1) identifying a loudspeaker mechanism causing transient response distortion, wherein:

(i) the identified loudspeaker mechanism includes a physical behavior of the component;

(ii) the transient response distortion of the identified loudspeaker mechanism is substantially linear;

(iii) the transient response distortion of the identified loudspeaker mechanism does not vary over time; and (iv) the transient response distortion of the identified loudspeaker mechanism does not vary with respect to a direction away from the loudspeaker;

(2) mathematically modeling the physical behavior of the component and performing electrical impedance measurements of the component to characterize the identified mechanism;

(3) determining the characterized mechanism's two-port response;

(4) establishing a target response for the characterized mechanism;, (5) calculating an ideal filter to achieve the target response; and (6) designing a cost-reduced filter based on the ideal filter to thereby form a loudspeaker mechanism algorithm (LMA) filter; and (b) for all components:

(7) applying minimum phase filters to equalize multiple frequency ranges;

(8) applying linear phase crossover filters; and (9) repeating any of the steps (1)-(8) above to achieve a combined loudspeaker response that exhibits reproduction accuracy.

10. The method of claim 9, further comprising, for each component, repeating steps (1)-(6) to form multiple LMA filters that each address a particular mechanism associated with the component.

11. The method of claim 9, wherein step (6) of designing a cost-reduced filter to achieve the target response comprises selectively employing one or more of a Finite Impulse Response (FIR) filter, Infinite Impulse Response (IIR) filter, and biquadratic (biquad) filter.

12. The method of claim 9, wherein step (7) of applying minimum phase filters comprises employing biquadratic (biquad) filters.

13. A loudspeaker system comprising multiple components and a series of digital signal processing (DSP) filters created to improve the loudspeaker's transient response, wherein the DSP filters comprise loudspeaker mechanism algorithm (LMA) filters that are each configured to correct a loudspeaker mechanism causing transient response distortion;

wherein the transient response distortion of the identified loudspeaker mechanism is substantially linear;

wherein the transient response distortion of the identified loudspeaker mechanism does not vary over time;

wherein the transient response distortion of the identified loudspeaker mechanism does not vary with respect to a direction away from the loudspeaker; and wherein each of the LMA filters is configured according to a method comprising:

characterizing the identified loudspeaker mechanism by mathematical modeling and electrical impedance measurements.

14. The loudspeaker system of claim 13, wherein at least one of the LMA filters is configured to correct a loudspeaker mechanism that has a limited amount of unit-to-unit variability.

15. The loudspeaker system of claim 13, wherein at least one of the LMA filters is configured to correct a loudspeaker mechanism that is a non-minimum phase system.

16. The loudspeaker system of claim 13, wherein at least one of the LMA filters is configured to correct a loudspeaker mechanism selected from a group consisting of: transient smear due to a compression driver phase plug configuration, acoustical horn resonances, and mechanical radial resonances in loudspeaker cones.

17. The loudspeaker system of claim 13, wherein at least one of the LMA filters is configured based on one or more of a Finite Impulse Response (FIR) filter, Infinite Impulse Response (IIR) filter, and biquadratic (biquad) filter.

18. The loudspeaker system of claim 13, wherein the method by which each of the LMA filters is configured further comprises:

determining the characterized mechanism's two-port response;

establishing a target response for the characterized mechanism;

calculating an ideal filter to achieve the target response; and designing a cost-reduced filter based on the ideal filter to thereby form a loudspeaker mechanism algorithm (LMA) filter.

* * * * *

UNITED STATES PATENT AND TRADEMARK OFFICE

CERTIFICATE OF CORRECTION

PATENT NO. : 8,081,766 B2
APPLICATION NO. : 11/368554
DATED : December 20, 2011
INVENTOR(S) : D. Gunness It is certified that error appears in the above-identified patent and that said Letters Patent is hereby corrected as shown below:

| COLUMN | LINE | ERROR |
|---|---|---|
| 14 (Claim 9, line 25) | 19 | After ";" delete "," |

Signed and Sealed this
Sixteenth Day of October, 2012

David J. Kappos

David J. Kappos
*Director of the United States Patent and Trademark Office*